United States Patent [19]

Kohlen

[11] Patent Number: 4,568,116

[45] Date of Patent: Feb. 4, 1986

[54] APPARATUS FOR PRODUCING A YARN-TYING KNOT

[75] Inventor: Karl-Heinz Kohlen, Monchen-Gladbach, Fed. Rep. of Germany

[73] Assignee: Hacoba Textilmaschinen GmbH & Co KG, Wuppertal, Fed. Rep. of Germany

[21] Appl. No.: 658,494

[22] Filed: Oct. 9, 1984

[30] Foreign Application Priority Data

Oct. 7, 1983 [DE] Fed. Rep. of Germany ..... 3336509

[51] Int. Cl.[4] ..... B65H 69/04

[52] U.S. Cl. ..... 289/2; 289/8

[58] Field of Search ..... 289/2, 8, 9, 10, 11

[56] References Cited

U.S. PATENT DOCUMENTS

| | | | |
|---|---|---|---|
| 2,670,230 | 2/1954 | Good Hue et al. | 289/8 |
| 4,506,920 | 3/1985 | Raussendorf et al. | 289/8 |
| 4,511,165 | 4/1985 | Prellwitz | 289/8 |

*Primary Examiner*—Louis K. Rimrodt

*Attorney, Agent, or Firm*—Karl F. Ross; Herbert Dubno

[57] ABSTRACT

A knotter for a chain for two yarn ends, e.g. in a spooling frame comprises a beak which is rotatable on a beak shaft and having a blade which can be opened and closed under the control of a slider plate mounted for vertical sliding movement on the front of a knotter housing. Behind this plate a transmission connected to the beak shaft also has a shaft carrying a cam which is rotated when an input shaft of the transmission is additionally displaced. The slider plate has a circular hole or edge which forms the control edge for the control end of the blade.

10 Claims, 11 Drawing Figures

APPARATUS FOR PRODUCING A YARN-TYING KNOT

FIELD OF THE INVENTION

My present invention relates to an apparatus for producing a yarn-tying knot, especially for spool or bobbin frames in which a fresh end of a yarn or thread may be tied to a yarn or thread on the bobbin or, conversely, a bobbin thread or another thread can be tied to a yarn of a yarn package as a fresh thread therefor.

More particularly, the invention relates to the tying of so-called catshead knot (Katzenkopfknoten) or bowline-type textile knots of the kind in which a loop in a pair of side-by-side yarn ends is twisted at least twice and one of the yarn ends is drawn through the loop. Such knots may also be referred to as chain knots or chain toggle knots.

BACKGROUND OF THE INVENTION

Yarn-tying knots of the aforedescribed type of spinning, spooling and twisting machines are made by mechanical means which generally comprise a guide or support device into which the two parallel thread ends are laid and so disposed that the parallel yarn ends span between the guides of this structure. The knotter can have a beak which engages the stretch of the two yarns between the guides and has a hook which is fixed to a shaft upon which the beak is mounted, and a movable shear half which can function as a clamping member and which is pivotal on the beak. In these systems, the engagement by the beak of the afore-mentioned stretch of parallel yarn ends enables rotation of the beak to form a loop and twist the loop through at least two turns, whereupon the gripper formed between the movable half and the fixed half of the beak can engage the one of the yarn ends which is to be drawn through the loop.

The opening and closing of the beak are controlled by a relatively complex arrangement in the knotter.

Spooling frames generally comprise a large number of spooling stations from which the cops or bobbins holding the yarn must be replaced when empty with new cops or bobbins on the respective spindles.

The free ends of the yarn which have left the cops are held by thread brakes and must be tied to the new thread or yarn of the replacement cop or bobbin by a knotting operation.

As noted, the preferred knot for this purpose is the so-called catshead knot which has also been termed a chain-toggle knot, a chain knot or a form of bowline and characterized by its simplicity and ease of formation, but possibly of greatest importance, by its small bulk so that the knot does not interfere with spooling operations. During the formation of the knot, moreover, minimal tension increases are generated in the yarn and the same applied to any knotting of excess yarn from the knot.

The simplicity of this knot which substantially involves the formation of a loop and the twisting of this loop through at least two turns before the free ends of the two strands is drawn through the loop, makes the knot especially advantageous for production by knotting machines or mechanisms.

The mechanism previously described, therefore, is comparatively simple and can be easily controlled.

The opening of the beak, however, requires a stationary member in prior art structures and for closing the blade member to thereupon sever the excess yarn. While this arrangement creates fabrication problems, it has the more significant disadvantage that with each rotation of the beak shaft the blade must open and close and because of this an additional gripper must be provided to hold the yarn ends out of engagement by the blade or in the opening between the blade and the fixed beak member when the turns are journaled to twist the loop before the free ends of the yarn ends are engaged. Consequently, the apparatus is of a relatively complex construction in spite of the fact that a comparatively simple means is provided for opening and closing the beak.

It has already been proposed to provide a movable control member for the opening and closing of the beak, this member being designed to open the beak only when the member is shifted into the operating position. This earlier control member is provided as a transverse element between two parallel pivoting arms which are pressed against the cam by spring force, the cam controlling the points in time at which the beak is to open and close.

Since the pivotal arms must describe a circular path about their respective pivot axes, the control member has a corresponding arcuate movement. The control member is thereby tilted with respect to the end or ends of the movable shear half to be engaged thereby. Because of this the sliding engagement of the control end of the shear half and the control member, considering the fabrication and mounting tolerance, satisfactory control of the beak is only achieved when the contact points are fabricated with precision. Since the cam and the arms control thereby are only in force-transferring contact and because the mountings of the pivot axes generally are located where they cannot be massive in nature, even after a limited operational time, especially when thick or dense yarns are cut with the considerable force thereby required, deformation and wear occurs so that the blade does not close properly and both the clamping effect desired and the shear effects are lost.

OBJECTS OF THE INVENTION

It is the principal object of the present invention to provide a knotter for producing a knot of the aforedescribed type in a pair of yarn or thread ends, especially for spooling nozzles and frames, whereby the aforedescribed disadvantages are avoided.

Another object of this invention is to provide an improved knotter for the aforedescribed purposes which is of simpler construction and provides more reliable knotting with a minimum of war and distortion even when comparatively thick or dense yarns are to be severed and gripped.

SUMMARY OF THE INVENTION

These objects and others which will become apparent hereinafter are attained, in accordance with the present invention, in a knotter having the aforedescribed beak mounted to rotate on the beak shaft, wherein the control member for the shaft and clamping element of this beak is provided in the housing so that it can move excessively in a plane and, most advantageously, in a plane perpendicular to the axis of the beak shaft. For the invention it is important that the angular or swinging movement of the control member be avoided. By providing the control member so that it can move successively in a plane, the linear displacement of its ensures that any tilting of the control member relative to the beak is excluded and sliding of the control end of the clamping and shear element of the beak is minimized. Knotting reliability is thereby greatly improved.

The control member, hereinafter referred to as a slider, can be formed as the front plate of a housing for the drive mechanism connected with the beak. When the beak shaft is oriented horizontally, the slider can be guided in the housing for exclusively linear vertical movement, i.e. direct and down movement. Because the slider forms the front plate of the housing it can be shaped with a circular hole whose edge defines a clamping surface cooperating with the control end of the clamping and shear element of the beak which may extend rearwardly to lie within this hole. This represents a significant simplification of the knotter because an extensively vertical linear movement of the slider can be maintained by guides built into the housing with ease and without losses of manufacturing tolerances.

The slider is provided with a cam follower in the form of a rearwardly extending pin engageable with a control cam which, in turn, may lie parallel to this front wall or slider. The cam, in turn, is driven by the drive mechanism for the beak shaft. The connection between the cam and the cam follower can be a form-fitting one if desired, either by virtue of the weight of the front plate or slider or by forming the cam as a slave cam, i.e. a groove between the flanks of which the pin is received. In general this enhances the reliability of the apparatus. Of course a spring can be provided to hold the pin against the cam.

In a comparatively structurally simple arrangement according to the invention, the cam is coaxial with a gear of the drive mechanism directly behind the cam and can be directly mounted on the gear directly behind the sliding front plate.

The rotary drive for the beak can comprise an articulated lever which can be rotated through a fraction of a revolution by an input from the spooling frame or some other actuating element, this lever being connected to an input shaft.

Parallel to this input shaft, I provide an intermediate shaft which carries the aforementioned gear, the latter being in mesh with a gear carried by the input shaft. This gear can in turn be connected to a gear on the beam shaft for rotating the beam. By suitable dimensioning of the gears, the transmission ratio between the input shaft and the cam and between the input shaft and the beam shaft, and, of course, the cam and the beam shaft can be ensured by a relatively simple and easily accessible transmission, all located behind the slidable front plate or the housing. The transmission is thus also relatively compact.

The side walls of the housing can have forwardly projecting formations formed with notches constituting the means into which the yarn ends are laid to span the path of the beak. These extensions can be integral compartments of the side walls of the housing and can be fabricated by most production techniques such as stamping.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
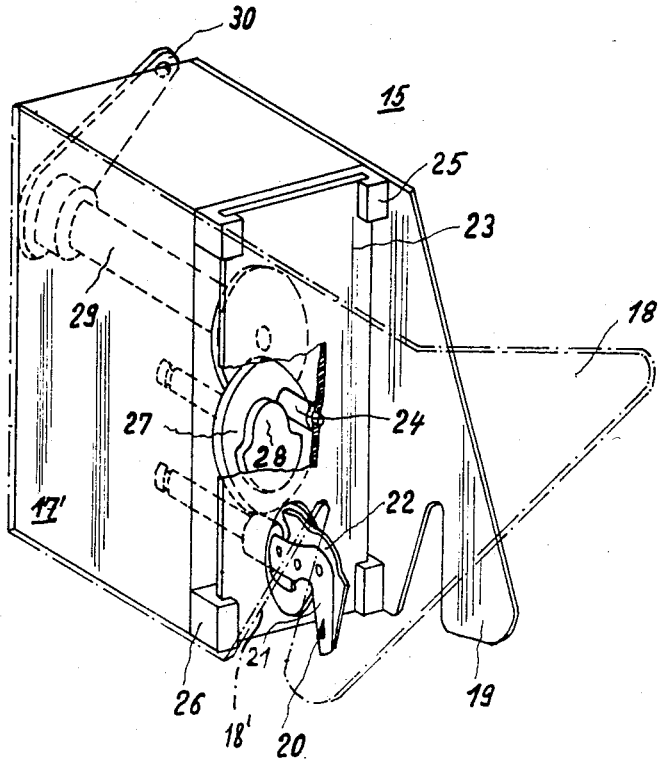
FIG. 1 is a perspective view with one front guide plate removed and represented only in phantom lines, of a yarn knotter in accordance with the invention.
Figure 3:
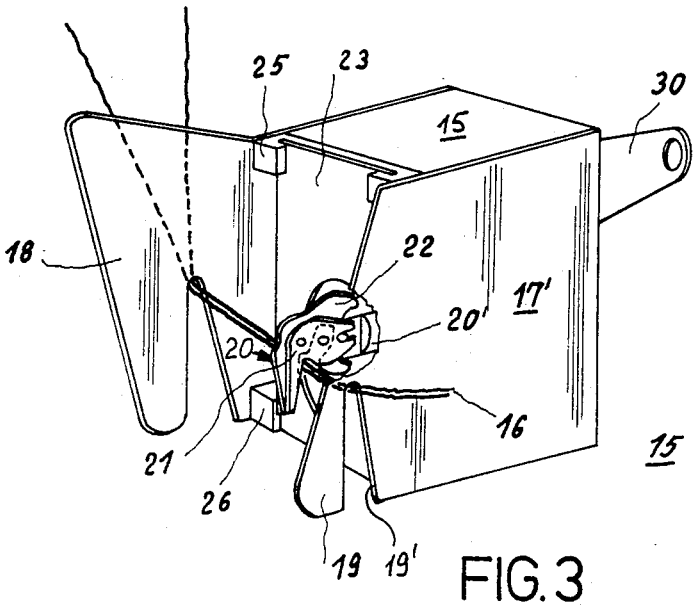
FIG. 3 is a perspective view of the knotter seen from the other side.

FIGS. 1 and 3 show a yarn knotter 15 for the knotting of two parallel yarn ends and, more particularly, for tying a catshead knot (Katzenkopfknoten) or bowline-type knot according to the invention. The yarn knotter 15 comprises a housing 17 whose side wall 17' is formed with a front guide plate 18 having a notch 18' receiving the yarn ends 16. The front plate has been removed in FIG. 1 and is represented only by phantom lines so that the structure behind this plate will be visible.

In FIG. 3, this guide plate 18 has been illustrated in elevation and the guide plate 19 on the opposite side wall 17', with its notch 19', has also been shown in its cooperating relationship therewith as a yarn-end holder straddling the tying beak.

The path of the yarn ends 16 through the crotches of the two notches has been illustrated in FIG. 3.

A tying beak 20 comprises a nonpivotal hook 21 which is generally L-shaped and which can engage the yarn ends 16 spanning the plates 18 and 19. The hook 21 is affixed to a beak-carrying shaft 20' via two pins which have not been shown so that the hook is rotatably entrained with this shaft, the pins and the shaft allowing a displacement of the hook 21 relative to the yarn ends spanning the plates 18 or 19.

The beak 20 also comprises a movable clamping blade element or shear half 22 which has an L-shape corresponding generally to that of hook 21.

Figure 8:
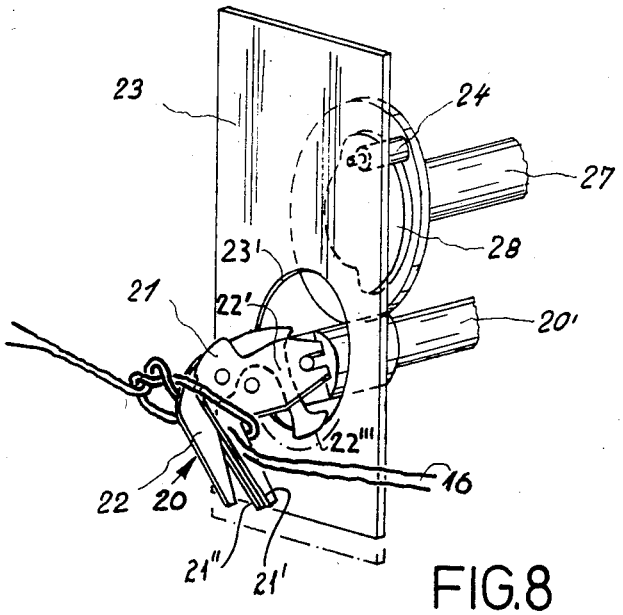

The L-shaped hook 21 of the beak 20 can be formed, as can best be seen from FIG. 8, from two spaced-apart plates 21' and 21''. Between the plates, the shear half 22 can pass so that this shear half or blade forms with the hook 21 a scissor which also, as is conventional, can act as a yarn clamp.

The tying beak 20 is journaled rotatably via its shaft 20' in bearing bushings 31 and 32 of the housing 17 and is held in position in the housing by a securing disk 36.

An input shaft 29 is likewise journaled in the housing via the bearing bushings 37 and 38 and is formed on its rearmost end, i.e. its end projecting from the housing, with a crank arm or lever 30 secured to the shaft 29 by a pin 39 so as to be rotatable with the shaft and to drive the latter.

At its opposite end, likewise projecting from the casing 17 but within a space defined between the housing wall 23 and this casing, the gear wheel or pinion 29' is mounted. This gear wheel forms the input gear of the drive train. The drive train includes an idler wheel 27' mounted upon an intermediate shaft 27 and meshing with the pinion 29', the gear 27' being provided with a larger diameter gear 27'' likewise on the intermediate shaft 27. Gear 27'' meshes with a pinion 20'' of the shaft 20' and the beak 20 in the clockwise sense. The gears and pinions described form a transmission which transforms a partial rotation or revolution of the shaft 30 through 60° into a rotation of the shaft 20' and the beak 20 through about 850°.

At the end of the movable shear half 22, a control end 22' is provided, this control end being formed as a rib which is substantially perpendicular to the shaft 20'.

The rib ends 22'' and 22''' of this rib are formed within a circular guide way 23' defined by an opening in the wall 23 which is shiftable in its plane and forms a slide. One or the other of the rib ends 22'', 22''' will engage the guide 23' depending upon the direction taken by the slider 23 relative to the beak 20.

The position of the slider 23 is correlated with the rotation of the beak 20.

To this end, the slider 23 carries a cam follower pin 24 which cooperates with the cam 28.

Figure 2:
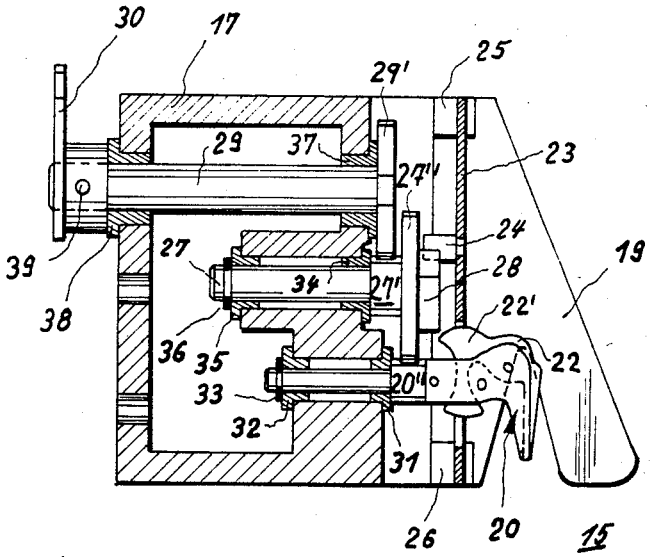
FIG. 2 is a vertical section through this knotter.

The cam 28 is mounted coaxially with gear 27'' on the intermediate shaft 27. It is located immediately behind the slider 23 (see FIGS. 1 and 2).

A rotation of the gear 27'' will, therefore, bring about a corresponding rotation of the cam 28.

The contour 28' of the cam 28 projects radially by comparison with the contour 28'' of the cam and effects with a corresponding rotation of the intermediate shaft 27, an entrainment of the cam follower pin 24 and thus an elevation of the slider 23. The latter is guided for such vertical movements in guides 25 and 26 on the housings.

In the operation of the knotter, two side-by-side or parallel yarn ends, e.g. from the new cop and from the yarn package onto which the yarn is to be spooled, are laid first in the notch of the yarn-holding plate 18 and then in the notch of the yarn-holding plate 19. These notches are so formed that the yarn ends 16 span the holders behind the L-shaped beak hook 21.

Figure 4:
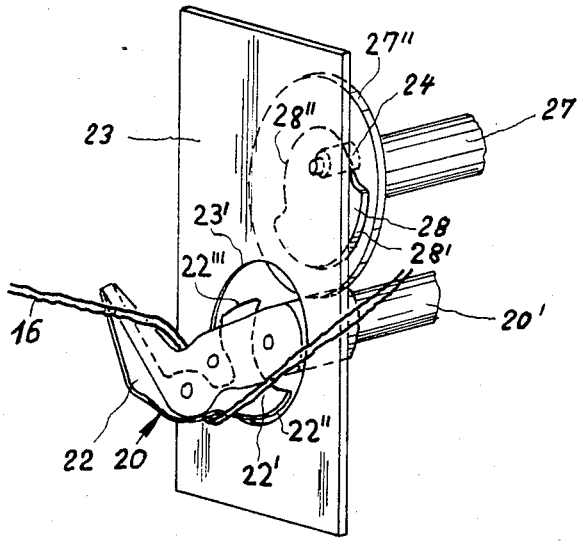
FIGS. 4 through 11 are fragmentary detail views illustrating the moving parts of the knotter in successive operating positions.
Figure 5:
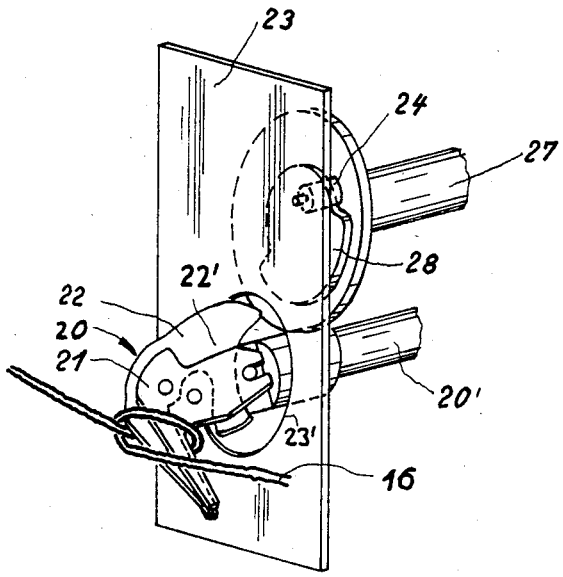
Figure 6:
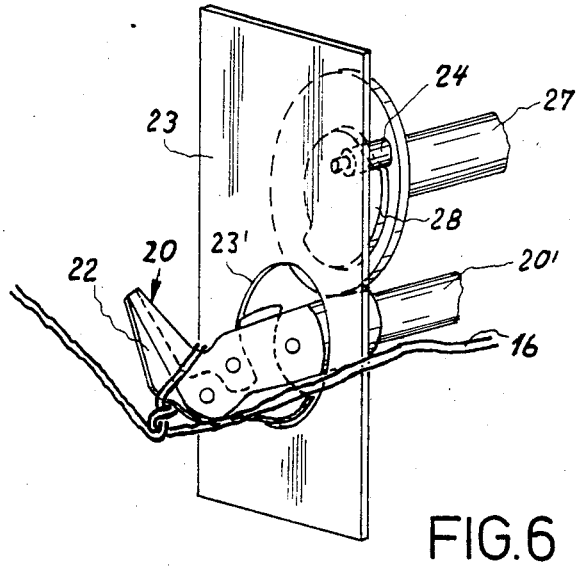

If the beak 20 is then rotated by an angular displacement of the lever 30, as can be seen from FIG. 4, the hook 20 will swing behind the yarn ends 16 to form a loop extending around the beak. A more complete loop is formed with a further half rotation of the shaft 20' as can be seen in FIG. 5. As the full loop is completed, it engages around the beak so that an additional half rotation brings the loop into the position shown in FIG. 6, the loop having a twist between it and the yarn ends.

Until this point, the cam follower 24 rode upon the curve 28'' of the cam 28. In rotation beyond the position shown in FIG. 6 the cam follower 24 rides up upon the cam curve 28' and the plates or slider 23 is thereupon lifted.

Figure 7:
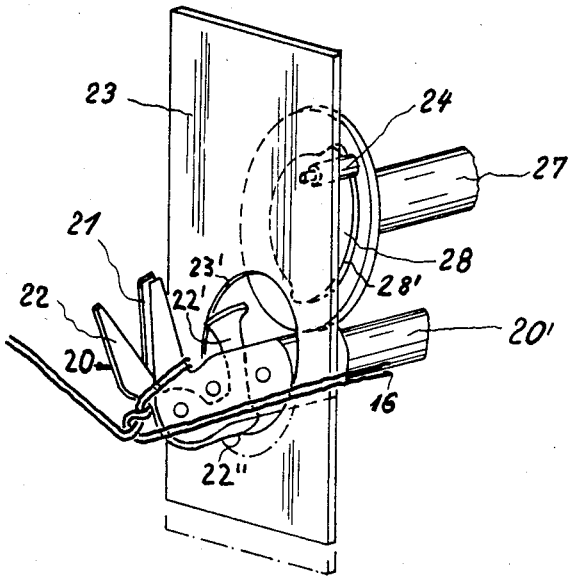
Figure 9:
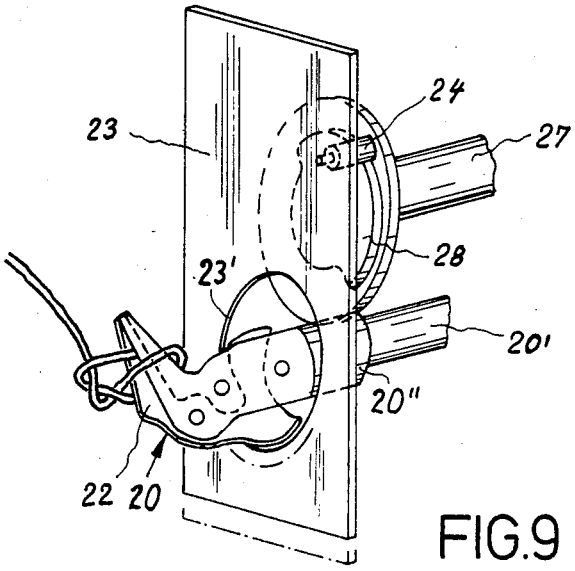
Figure 10:
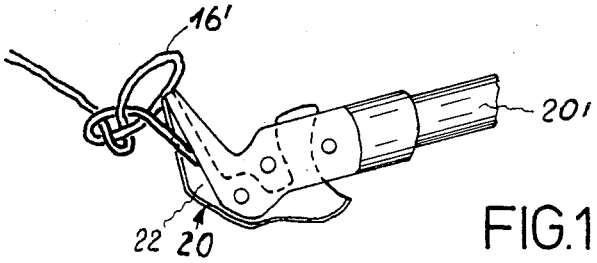
Figure 11:
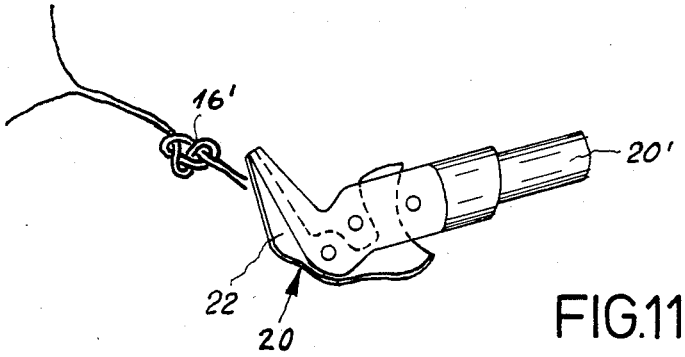

While previously the control edge 23' did not engage the control end 22' of the hook 22, the lifting of plate 23 raises the lower portion of the edge 23' so that the beak is opened (FIG. 7) as a second twist is imparted to the loop. The open beak then engages the free ends of the yarns 16, shown to extend to the right of FIG. 7 between the blade 22 and the nonpivotal hook 21, the rib end 22' then riding along the lower portion of the edge 23'. With a slight further rotation, the clamped residual end is held between the blade and the hook of the beak after the free end has been cut off and the loop is returned to the position shown in FIG. 9 so that it can be pulled as illustrated at FIG. 10 from this hook. Since the cut end is still held by the beak, the knot is tightened by the tension applied by the spooling frame with the beak at standstill.

Rotation then continues and the cam 28 allows the beak to open.

The process can then be repeated for another knotting operation.

In the described manner, therefore, the knot formation requires two and a quarter rotations of the beak. More complex chain knots can be made, however, by utilizing more than two turns or a simpler knot can be made but utilizing only a single turn.

In any case, all that is essential is that the cam control the slider 23 so that the beak is opened only after it has made at least a third of the total number of turns for generating respective twists in the loop or half of a single turn when a single twist is made. This can be controlled simply by selection of the starting position of the lever 30.

The resetting of the slider 23 is effected during the return of the beak by restoring force applied by the movable blade half which can be spring-biased if desired into its closed position or by a portion of the blade half opposite the control end thereof.

The knotter provides an extremely simple and effective way of forming double chain knots of the aforedescribed type for, for example, smooth threads which require such knots or more complex knots to prevent slips.

I claim:

1. An apparatus for knotting two yarn ends, comprising:

a pair of yarn holders adapted to receive a pair of parallel yarn ends whereby said yarn ends span a space between said holders;

a housing disposed between said holders;

a shaft rotatably mounted in said housing and provided with a beak adapted to engage the yarn ends spun between said holders and rotate on said shaft to form a loop in said yarn ends, said beak having a nonpivotal hook and a blade member pivotal relative to said hook and displaceable between an open position of said blade member wherein said beak can receive said yarn ends, and a closed position wherein said yarn ends can be clamped between said blade member and said hook, said blade member having an actuating end rotatable in a plane substantially perpendicular to said shaft;

a transmission on said housing operatively connected to said shaft for rotating same;

a slider forming a front plate on said housing and provided with a control edge engageable with said end, said slider being mounted on said housing for movement of said plate; and cam means on said housing connected with said transmission for displacing said slider to control said blade member for engagement of yarn ends in said beak after a loop-forming rotation thereof to enable said yarn ends to be drawn through said loop.

2. The apparatus defined in claim 1 wherein said slider is formed with a circular opening whose edge forms said control edge, said beak extending through said opening.

3. The apparatus defined in claim 2 wherein said slider is mounted for vertical displacement on said housing.

4. The apparatus defined in claim 2 wherein said cam means includes a rearwardly extending cam follower on said slider, a shaft forming part of said transmission and extending parallel to the shaft provided with said beak, and a cam on said shaft forming part of said transmission and engaging said cam follower.

5. The apparatus defined in claim 4 wherein said cam is coaxial with a gear of said transmission meshing with a gear on said shaft provided with said beak.

6. The apparatus defined in claim 5 wherein said cam is arffixed to said gear on said shaft forming part of said transmission.

7. The apparatus defined in claim 6 wherein said transmission further includes a swingable lever, and input shaft connected to one end of said lever and journaled in said housing while being provided at its opposite end with a further gear meshing with the gear provided on said shaft forming part of said transmission, all of said shafts having parallel axes.

8. The apparatus defined in claim 7 wherein said housing is provided with forwardly extending guides, said slider being a plate having edges engaged in a slidable guide by said guides.

9. The apparatus defined in claim 1 wherein said housing is provided with forwardly extending guides, said slider being a plate having edges engaged in a slidable guide by said guides.

10. The apparatus in claim 2 wherein said housing is provided with forwardly extending guides, said slider being a plate having edges engaged in a slidable guide by said guides.

* * * * *